United States Patent [19]

Zapara et al.

[11] 4,127,929

[45] Dec. 5, 1978

[54] LAMINATED WOOD WAREHOUSE SUPPORT STRUCTURE

[75] Inventors: Gerald A. Zapara, Santa Ana; Lyle G. Zapara, Newport Beach, both of Calif.

[73] Assignee: National Storage Systems, Inc., Newport Beach, Calif.

[21] Appl. No.: 773,513

[22] Filed: Mar. 2, 1977

[51] Int. Cl.[2] ..... A47B 57/00; E04B 1/26

[52] U.S. Cl. ..... 29/469; 108/59

[58] Field of Search ..... 29/469, 155 R, 432, 29/155 C; 52/741, 648, 93, 90, 721, 236.3; 108/59; 211/134

[56] References Cited

U.S. PATENT DOCUMENTS 1,768,861 7/1930 Richards ..... 52/86

2,375,726 5/1945 Bales ..... 108/64 X

FOREIGN PATENT DOCUMENTS 66920 1940 Czechoslovakia ..... 52/648

*Primary Examiner*—Milton S. Mehr

*Attorney, Agent, or Firm*—Romney, Schaap, Golant, Scillieri, Disner & Ashen

[57] ABSTRACT

A laminated wooden rack structure forming multiple vertically layered storage bays extending longitudinally along an access aisle. The floor of each storage bay is supported by a pair of upright columns having beams sandwiched therebetween and stabilized at their junction by upper and lower blocks. In one embodiment, the lower block has a portion extending beyond the edges of the columns, and a gusset overlies said portion of the lower block and the adjacent portion of the beam.

10 Claims, 13 Drawing Figures

LAMINATED WOOD WAREHOUSE SUPPORT STRUCTURE

BACKGROUND OF THE INVENTION

This application refers generally to a wooden structural support system for storage racks, and more particularly to a method of prefabricated construction using a plurality of unique laminated upright column members carrying lateral arms for supporting several vertically spaced layers of shelving extending longitudinally between the columns.

Steel support structures have been typically used in the past for supporting multi-layered storage racks, since the less expensive wooden support structures have been unreliable. For example heavy loads placed on one portion of a wooden storage rack have tended to sag the wooden support arms and loosen their junction with the upright columns. Thus, over a period of use, and also because of wood shrinkage, the arms tend to move up and down about their central connecting point with the vertical columns resulting in loose, insecure and unstable support for the storage racks and the loads thereon. However, the steel is more expensive and also is heavier itself, thus making it an excessive capital investment in order to construct a suitable warehouse storage facility.

The present invention provides for a laminated wood rack system which is less than half as expensive as a steel system, is easily constructed in modular form prior to erection, and which provides all of the advantages of the steel system, except for the vertical adjustability of shelves, which adjustability has not been found to be necessary in many installations such as furniture warehouses.

The laminated version includes an upright tower having lateral arms sandwiched therein and extending outwardly therefrom. Some form of blocking is provided above and below the lateral arms to hold the arms in position when weight is applied on one or both of the outstretched arms.

More specifically, it is desirable to provide a wooden storage rack having a pair of upstanding columns with lateral arms sandwiched therebetween. An additional specific object is to provide blocking below the lateral arms and extending beyond the side edge of the columns to further stabilize the arms when supporting a load. An additional object is to separately connect the lateral arms directly to the vertical column edges through a gusset in order to further stabilize the construction.

Additional objects and purposes and advantages of the invention will be apparent to those skilled in the art in view of the following description of a preferred embodiments of the invention.

Figure 1:
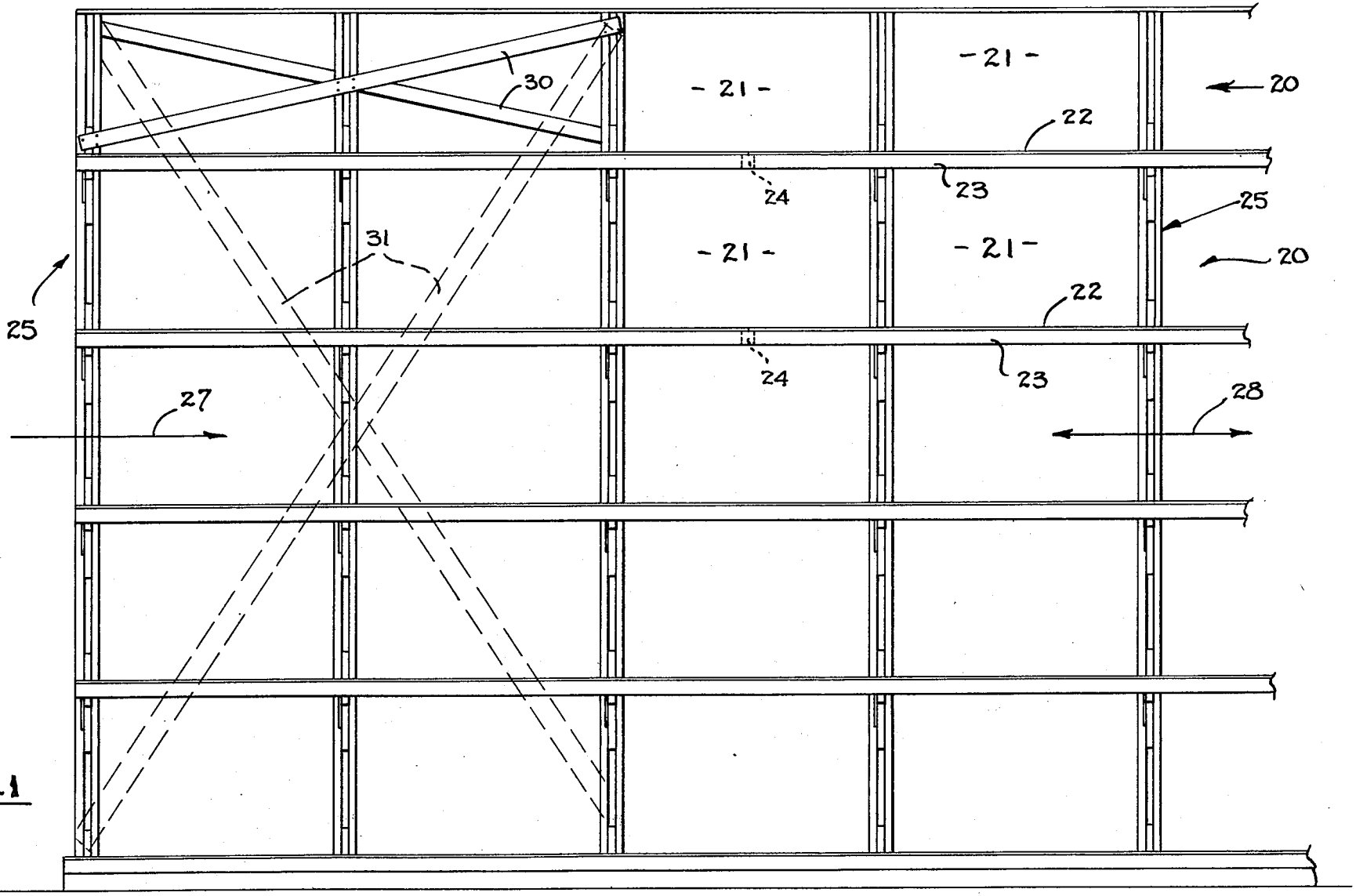
FIG. 1 is a front elevational view of a presently preferred embodiment of the invention showing five vertically spaced storage shelves.

Referring more specifically to the drawings, the invention includes a plurality of vertically adjacent spaces 20 which are separated into a sequence of horizontally adjacent storage bays 21 which are defined along their bottom and top boundaries by flooring 22 supported by longitudinal joist 23 and lateral joist 24 extending therebetween, all the joists positioned preferably along the periphery of the flooring for maximum stability. The flooring and underlying joists are carried by a series of vertical columns 25 which provide the total support for the various joists and flooring thus providing front access in the direction shown by the arrow 26, and free end access shown by the directional arrow 27. Also, the invention allows bay/bay access in the longitudinal direction as shown by the directional arrow 28 as well as bay/bay access transversely as shown by the directional arrow 29, although since the bays are generally loaded from the front the transverse access is not deemed as important. In this regard, in some instances it was found desirable to provide diagonal braces 30 or alternately 31 which help to stabilize and integrate the entire structure, particularly during construction, while also partially dividing the opposing bays. Although any form of hangers could be used for mounting the floor joist, the conventional hanger brackets 32 were found suitable and easily used. Also, as shown in the drawing, the aforementioned construction typically used with a conventional guide railing as identified by 33 to protect the structure from a mobile loader (not shown) which moves freely in a longitudinal direction along the front of the storage bays.

Figure 10:
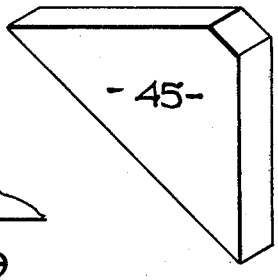
FIG. 10 is an isometric view of a preferred form of a lower support block.
Figure 9:
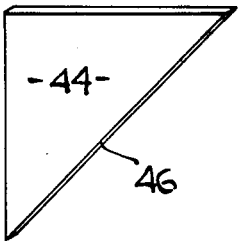
FIG. 9 is a isometric view of an exemplary gusset.

Referring now to the construction details, a series of laminated support junctions are formed by individual column members 40 having arm beams 41 sandwiched therebetween. The arm beam is held in position by an upper block 42 and lower block 43, and supports the flooring directly as an enlarged joist member as well as providing the support for the longitudinal and lateral joists 23, 24. This laminated structure is shown in its simpler form in the embodiment of FIGS. 12 and 13. In order to facilitate construction, and maximize the width of its upper support surface, the lower block can be cut from conventional lumber stock as a unitary member (not shown) or as a pair of truncated triangular members 45 (see FIG. 10).

Figure 11:
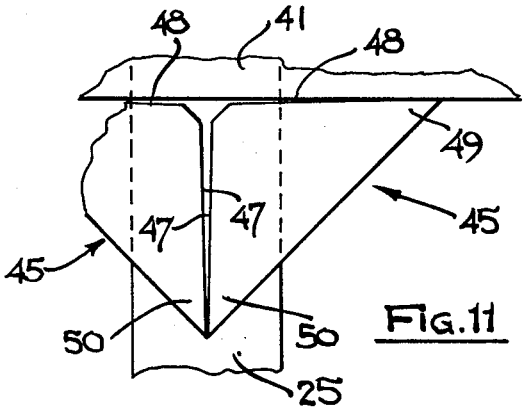
FIG. 11 is an end view showing the positioning of a pair of lower support blocks.

In a unitary triangular member adapted to form a lower block, the hypotenuse surface 46 is preferably positioned directly against the beam 41 to maximize the support base for the beam. The support base may be elongated even further by using a pair of the triangular members 45 so that leg surfaces 47 face each other, leg surfaces 48 underly the beam, with the hypotenuse surfaces diagonally extending between side apex 49 and bottom apex 50, respectively for each member 45, since precise cutting of the outer surface of 45 to provide continuously abutting surfaces can be partially tapered as shown in FIG. 11 to assure abutting contact at the apices 49, 50.

In the course of developing the support structure of the present invention, it was discovered that optimum stability was achieved by using a gusset 51 attached to and overlying a portion of the exposed faces of the lower block 43 (or alternatively 45) and the adjacent beam surface as well as abutting the adjacent vertical surface of the adjacent individual column 40. Also, it was found in most instances that a pair of gussets were usually needed on only one side of each junction, although use on both the front and back might be useful for excessive loads.

Thus, the laminated wood junction achieves the stability of a steel rack system, notwithstanding the direct downward rotational force exerted on the loadside of the beam, the upward counter-rotational force exerted on the beam arm opposite the load, or the vertical downward force exerted at the midpoint of the junction. Moreover, wood shrinkage which typically occurs over a period of time does not adversely affect the stable support provided by the laminated junction.

Figure 2:
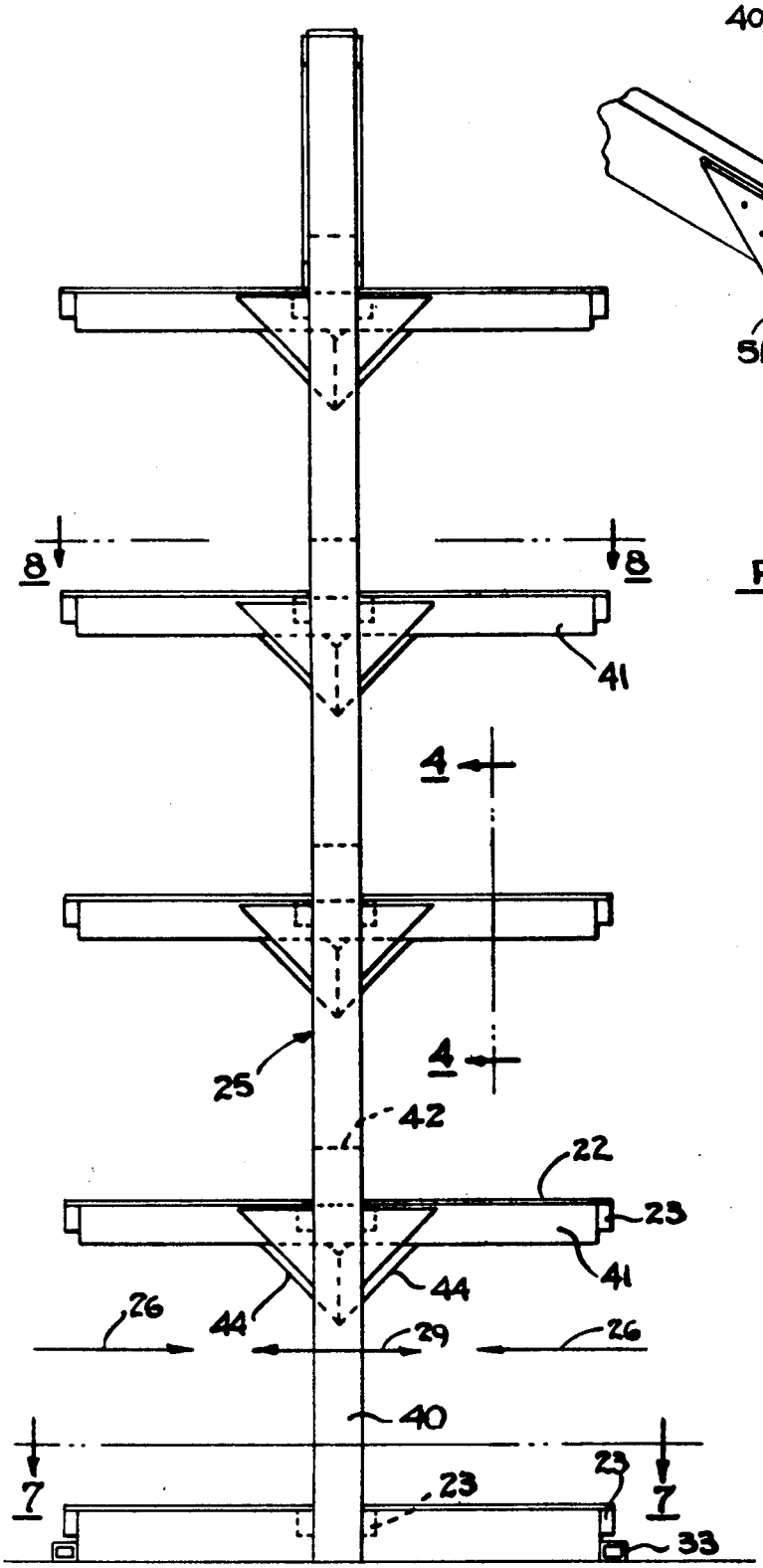
FIG. 2 is an enlarged end elevational view of the embodiment of FIG. 1.
Figure 3:
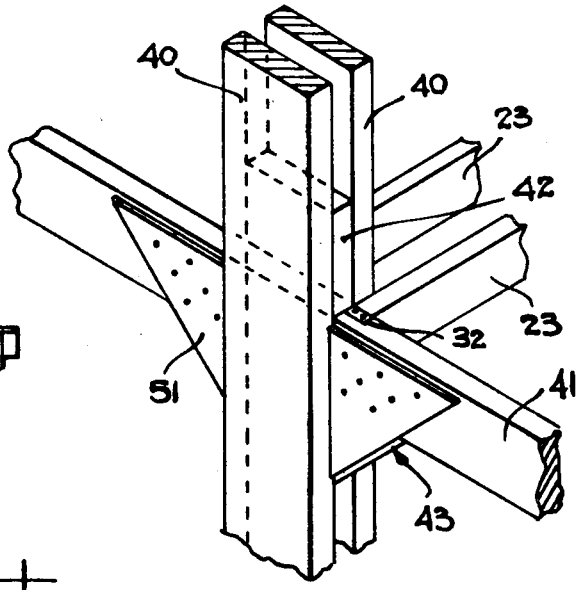
FIG. 3 is an enlarged isometric view showing the details of a laminated above-the-ground support junction.
Figure 4:
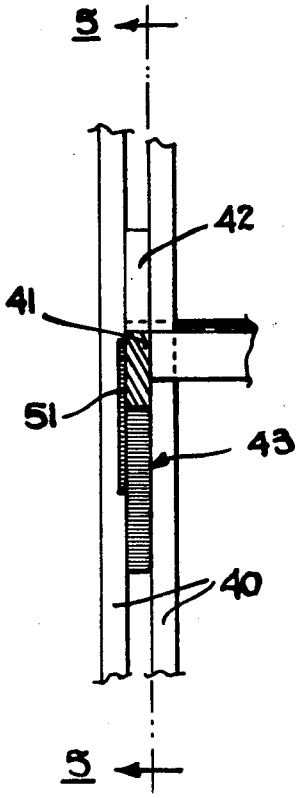
FIG. 4 is a fragmentary sectional view taken along the line 4—4 in FIG. 2.
Figure 5:
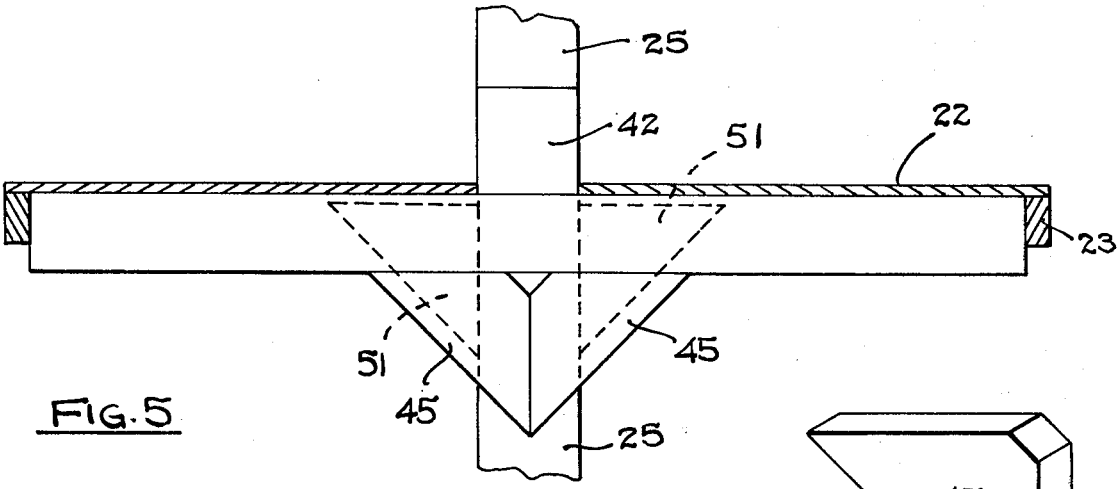
FIG. 5 is a sectional view taken along the line 5—5 in FIG. 4.
Figure 12:
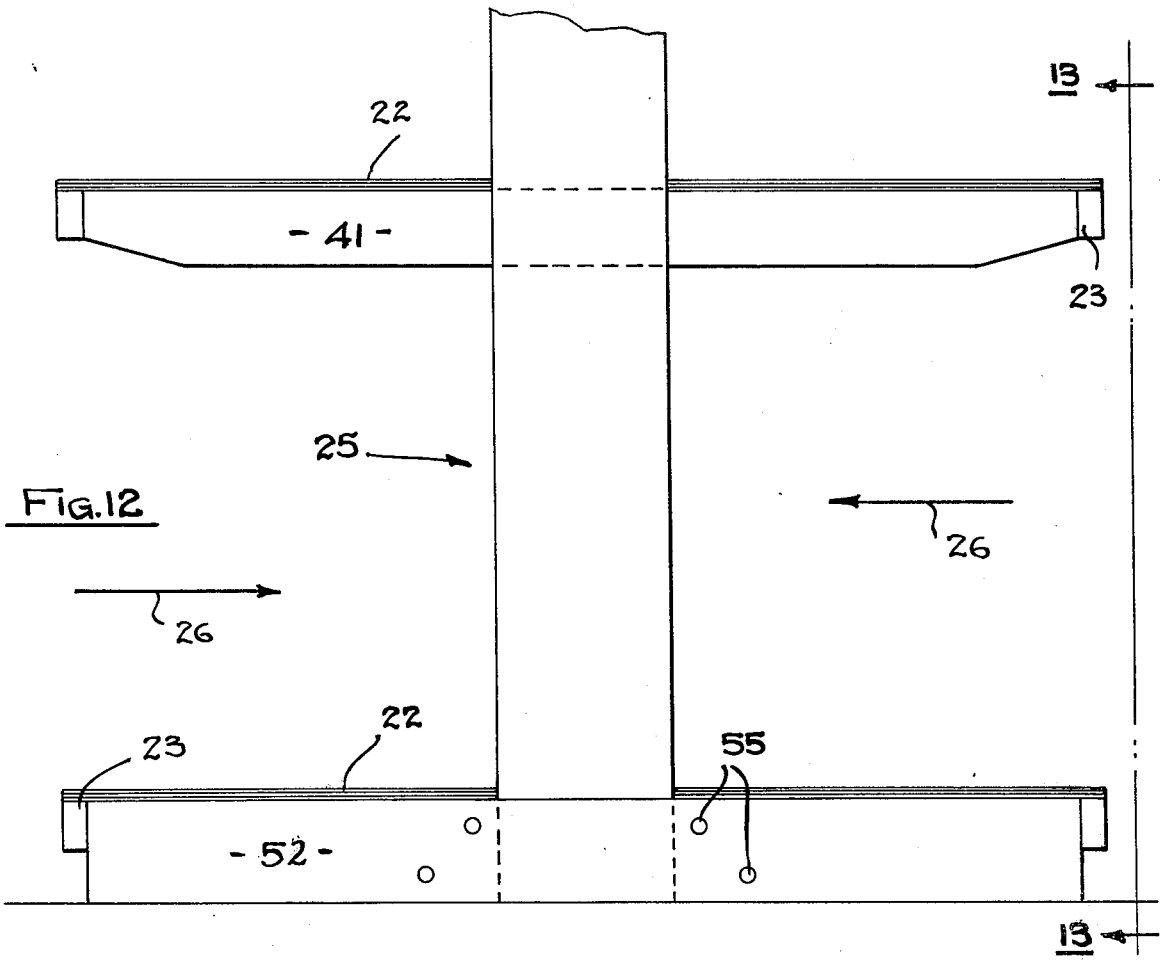
FIG. 12 is an end elevational view of an alternate form of construction of the invention.
Figure 13:
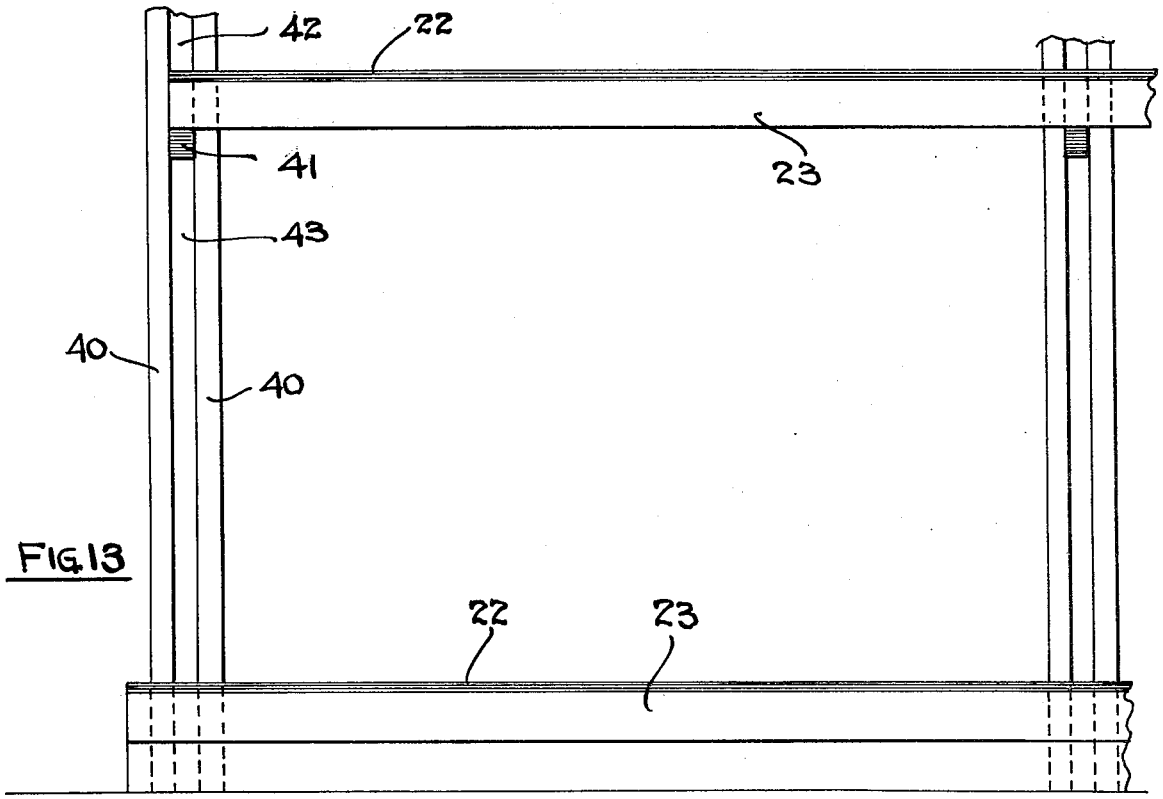
FIG. 13 is a front elevational view taken along the line 13—13 in FIG. 12.

The evolution from the initial embodiment of FIGS. 12–13 to the increased stability of the embodiment of FIGS. 1–3 with less lumber involved occurred as a result of experimentation. Although it is within the spirit of the invention to use the gusset with the lower block 43 of the type shown in FIGS. 12–13, or to use the lower block 43 of the type exemplified by the members 45 without the gusset, it was found that optimum stability with minimum lumber and expense was obtained with the gusset/block combination of FIGS. 1–3 of the preferred illustrated embodiment.

The laminated ground support junction is necessarily stronger than the above-the-ground junctions previously described. In this regard, as beam **41*a* is sandwiched between the bottom ends of the columns 40, with one or more ground beams 52 overlying the faces of the columns. Right blocking members 53 and left blocking members 54 analogous to the upper and lower blocks 42, 43 abut the edges of the columns and are held in position by locking bolts 55** passing through the beams and blocks and preferably positioned at different heights to avoid splitting the lumber. Additional blocking (not shown) may be used if necessary at the outer ends of the beams to hold them in spaced fixed relationship to each other.

In the simpler version of FIGS. 12 and 13, beams are sandwiched between the two vertical columns which comprise extremely wide wooden supports such as 2 × 16 or 2 × 18 lumber which have equally wide blocking above and below the beams, in abutting relationship to the top and bottom edges of the beam at the junction between the two columns. The blocks, columns and beam are affixed together by screws, nails, or the like. However, in some instances, this construction was not found satisfactory, since when the load became excessive on one side of the rack, as compared to the other side, the lateral beam arm tended to rotate in the direction of the load around the junction as a pivot.

Accordingly, it will be appreciated that the improved embodiment generally shown in FIGS. 1–3 incorporates a bottom block extending outwardly beyond the side edges of the vertical column, thus providing additional support to the beam arm having the load directed against it. In the preferred form, this lower block is formed by two substantially identical members which are matched in opposing relationship to extend outwardly beyond the sides of the vertical columns. The top edge of the block substantially coincides with and abuts against the lower edge of the lateral beam arm, while the inside edges of each block are in mutual engagement.

The additional stability is provided by the gusset which overlies the exposed portion of the lower block extending beyond the columns and also overlies the adjacent surface of the beam arm, thus providing an additional tie connection. Two gussets are preferably used and positioned to abut opposite edges of the vertical columns, virtually eliminating any excessive undesirable movement of the lateral beam arms as loads are added, shifted or removed from the individual bays on the racks.

The efficient use of lumber made possible by the present invention is exemplified in the embodiment of FIGS. 1–3 wherein the ground beams and vertical columns are formed by 2 × 8 lumber; the beams are formed by 2 × 6 lumber; the joist are formed by 2 × 4 lumber; the gusset is formed by ⅜ inch plywood; and the flooring is formed by ¾ inch particle board.

Figure 8:
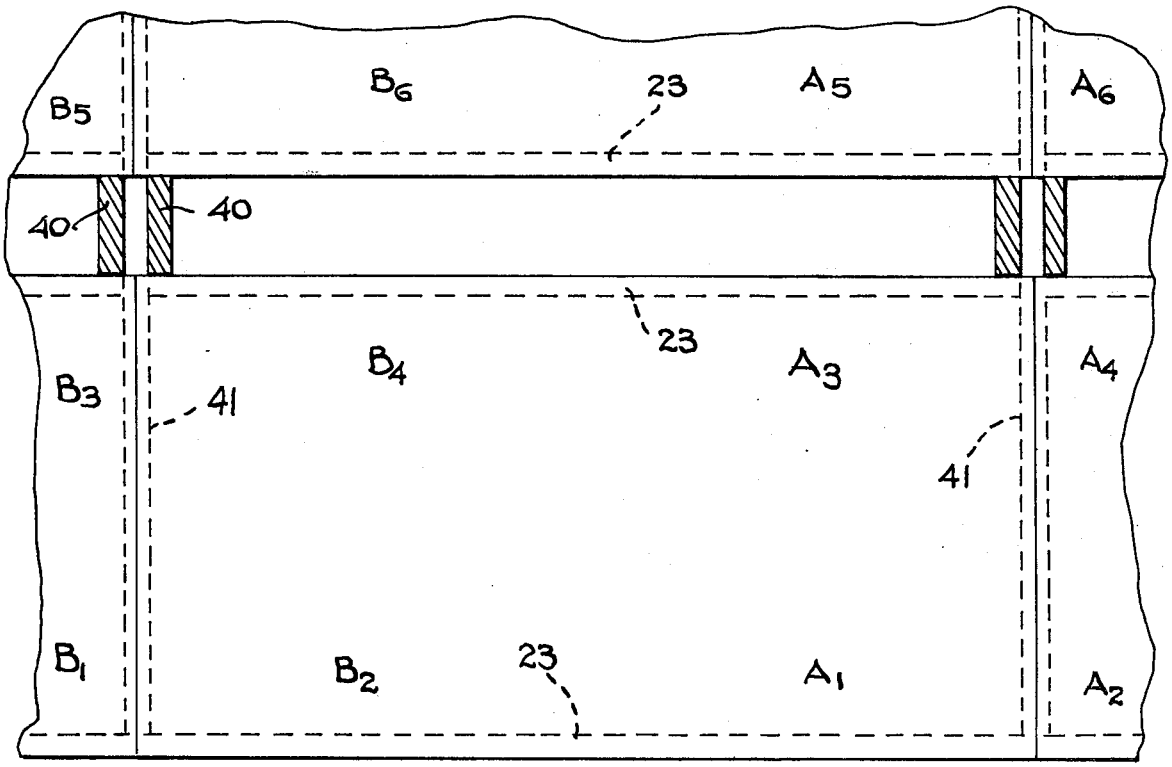
FIG. 8 is a top plan view partially in section taken along line 8—8 in FIG. 2.
Figure 6:
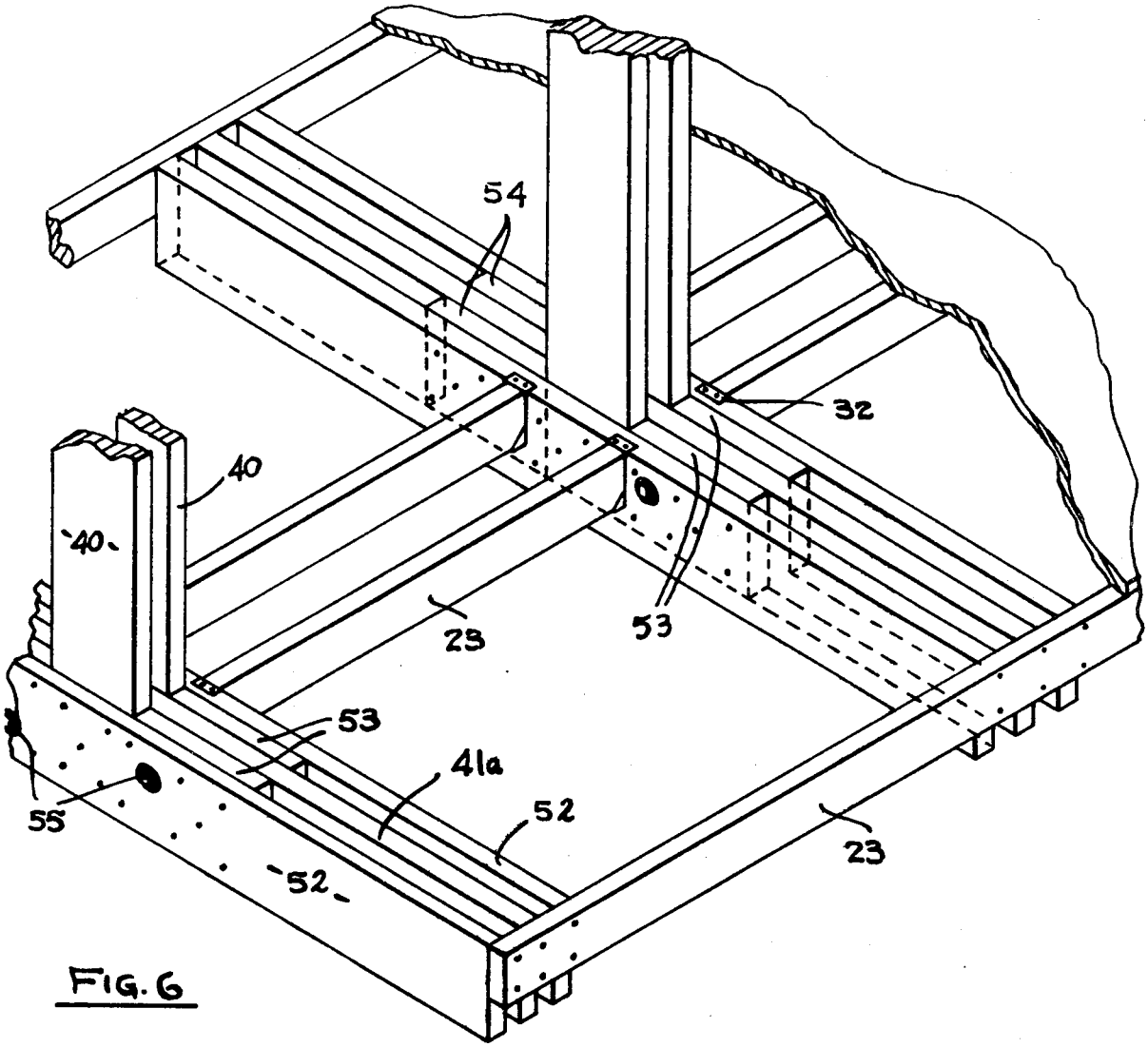
FIG. 6 is an enlarged isometric view of an exemplary laminated ground support junction.
Figure 7:
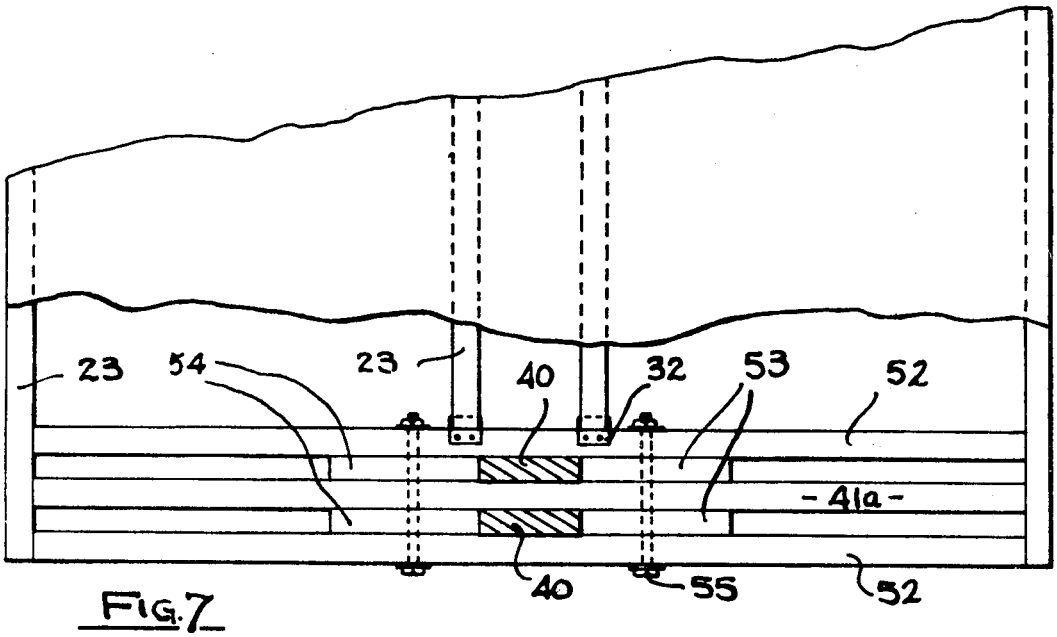
FIG. 7 is a top plan view partially in section taken along the line 7—7 in FIG. 2 showing the exemplary laminated ground support junction of FIG. 6.

The basis for using support components with progressively greater cross-sectional area to carry progressively larger loads is illustrated in FIG. 8 wherein each storage bay is subdivided into quadrants of substantially equal surface area. Since the amount of surface area generally determines the amount of load, the following comparisons can be made from the drawing. The smallest diameter support components are the floor joist 23 which each support two quadrants such as $A_1B_2$ for a front longitudinal joist, and $A_3B_4$ for a back longitudinal joist. The arm portion of each intermediate diameter beam supports four quadrants, such as $A_1$ through $A_4$ for one arm, and $B_1$ through $B_4$ for another arm. The large diameter columns 40 and their large diameter beam legs on the ground level support eight quadrants on multiple levels, such as $A_1$ through $A_8$ as well as $B_1$ through $B_8$ on the level shown in FIG. 8 (the latter two quadrants of these last two groupings are not shown).

The lower block is formed by cutting a 2 × 8 into matching alternating triangular blocks. In the exemplary form, the vertical columns were placed 6 feet apart thus forming individual bays along the length of the storage racks, with a typical shelf extending laterally about 42–49 inches from each vertical columns.

This form of construction lends itself to easy assembly since the columns and both the ground and suspended beam arms with the blocking and laminated junctions can all be attached together into a single integral unit with predetermined specifications, on a mass production basis before assembly starts. Such assembly is accomplished by placing in upright position a plurality of the columns and nailing the diagonal X-braces to hold them in position. The back and front longitudinal floor joist can then be hung between and along the ends of the beams, and any additional transverse joist added between and parallel to the beams for carrying any flooring joints which will not fall at the preferable point directly on a beam. The flooring can than be nailed to the underlying joist and beam members. Thus, it takes a minimum number of man hours to assemble the unit on site, thereby facilitating the quick construction of multilevel storage space which is immediately ready for use.

This enables the rest of the warehouse to remain in use during the assembly. Of course, a customized pattern or jig is made for each individual job, and once it is made, the laminated support columns can be built successively in quick order without taking up any space in the warehouse itself. Moreover, all of the wood incorporated in the structure may be conventional wood which can be purchased with little or no advance notice from local lumber yards.

Although exemplary embodiments of the invention have been disclosed for illustrative purposes, it will be understood that various changes, modifications and substitutions may be incorporated in such embodiments without departing from the invention as defined by the claims hereinafter.

We claim:

1. A method of making a multilevel wooden storage rack structure from stock lumber including the steps of:

prefabricating a plurality of central towers formed by a pair of columns having a laminated ground support junction permanently joining a pair of oppositely-directed lateral ground arms to the base of the central tower, and having additional laminated support junctions vertically spaced predetermined distances from the ground support junction and from each other, permanently joining pairs of oppositely-directed lateral suspended arms to the central tower without any support underlying the free ends of the suspended arms;

standing the central towers in upright position on their lateral ground arms in spaced apart aligned relationship;

connecting floor joists between the corresponding lateral arms of adjacent central towers with the floor joists in substantial horizontal alignment with the lateral arms; and laying flooring material on the floor joists.

2. The method of claim 1 wherein said connecting step includes connecting longitudinal floor joists between adjacent upright columns, and wherein said laying step includes laying flooring materials on both the longitudinal floor joists and the lateral arms whereby the lateral arms act as a header engaging and supporting the longitudinal floor joist as well as directly supporting the overlying flooring material.

3. The method of claim 2, wherein said laying step includes positioning the junction between adjacent floor material pieces directly over the lateral arms to eliminate the need for additional transverse joist members other than the lateral arms themselves.

4. The method of claim 1 wherein said prefabricating step includes laminating a first element of the lateral ground arms between the pair of columns and laminating two other elements of the lateral ground arms outside the columns to sandwich the columns therebetween.

5. The method of claim 1 wherein said prefabricating step includes laminating an upper block between the columns immediately above each lateral suspended arm member.

6. The method of claim 1 wherein said prefabricating step includes laminating a lower block member between the columns immediately below each lateral suspended arm member.

7. The method of claim 6 wherein said prefabricating step includes laminating a lower block member having sufficient width to extend beyond both opposite lateral edges of the columns.

8. The method of claim 1 wherein said prefabricating step includes laminating individual columns of a first cross-sectional size with lateral suspended arms of a second cross-sectional size less than the size of the column members.

9. The method of claim 8 wherein said connecting step includes connecting floor joist having a third cross-sectional size less than the size of the lateral suspended arms.

10. The method of claim 9 wherein said connecting step includes using conventional two-by-four lumber for floor joists, and said prefabricating step includes using conventional two-by-six lumber for lateral suspended arms and conventional two inch lumber not smaller than two-by-eight for upright columns.

* * * * *